US008107797B2

(12) United States Patent
Abodreham et al.

(10) Patent No.: US 8,107,797 B2
(45) Date of Patent: Jan. 31, 2012

(54) REFLECTION HEATING FAN

(75) Inventors: David Abodreham, Herzliya (IL); Jacob Ben-David, San Pedro, CA (US)

(73) Assignees: David Abodreham, Herzliya (IL); Jacob Ben-David, Guangdong (CN); Nissim Mashiah, Or Yehuda (IL)

( * ) Notice: Subject to any disclaimer, the term of this patent is extended or adjusted under 35 U.S.C. 154(b) by 816 days.

(21) Appl. No.: 11/994,218

(22) PCT Filed: May 29, 2006

(86) PCT No.: PCT/IL2006/000628

§ 371 (c)(1), (2), (4) Date: Dec. 28, 2007

(87) PCT Pub. No.: WO2007/000752

PCT Pub. Date: Jan. 4, 2007

(65) Prior Publication Data

US 2008/0205862 A1 Aug. 28, 2008

(30) Foreign Application Priority Data

Jun. 29, 2005 (IL) ..... 169459

(51) Int. Cl.
*F24H 3/02* (2006.01)
*F24D 13/00* (2006.01)

(52) U.S. Cl. ..... 392/361; 392/347

(58) Field of Classification Search ..... 392/347–378
See application file for complete search history.

(56) References Cited

U.S. PATENT DOCUMENTS 2,334,501 A * 11/1943 Moeller ..... 392/376
4,218,912 A 8/1980 Antesberger
4,835,367 A 5/1989 Hoffman
5,636,318 A 6/1997 Polaert et al.
6,160,956 A 12/2000 Pelonis
6,393,211 B1 5/2002 Jolan et al.
6,529,608 B2 * 3/2003 Gersabeck et al. ..... 381/110
2002/0100200 A1 * 8/2002 Callander et al. ..... 40/800
2004/0218912 A1 11/2004 Shapiro et al.
2008/0091432 A1 * 4/2008 Dalton et al. ..... 704/275

FOREIGN PATENT DOCUMENTS

GB 699230 5/1952
JP 56-102636 8/1981

OTHER PUBLICATIONS

International Search Report for PCT/IL2006/000628. International Preliminary Report on Patentability for PCT/IL2006/000628. Written Opinion of the International Search Authority for PCT/IL2006/000628.

* cited by examiner

*Primary Examiner* — Daniel L Robinson
(74) *Attorney, Agent, or Firm* — Martin Fleit; Paul D. Bianco; Fleit Gibbons Gutman Bongini & Blanco PL

(57) ABSTRACT

The present invention discloses a reflection heating fan comprising at least one fan rotating over a main axle, at least one heating element and at least one reflector, said heating element and reflector are continuing from said main axle, wherein said heating element indirectly heats an air stream by reflecting heat produced by a heating element into the air stream produced by said fan. The present invention also discloses a method of indirectly heating a stream of air, comprising applying energy to a heat emitting element incorporated into a bi-functional rotation axle, reflecting said energy by means of a reflective surface into an air stream produced by applying rotation to a bladed fan structure, achieved by transferring the power from a motor through the bi-functional axle to at least one bladed fan structure.

9 Claims, 2 Drawing Sheets

REFLECTION HEATING FAN

FIELD OF THE INVENTION

The present invention relates to a reflection heating fan.

BACKGROUND OF THE INVENTION

Conventional heating fans employ an electrical fan constructed of two or more blades circulating by force of an electrical motor on an axle, and thereby forcing ambient air through a volume containing a heat source, such as an electrical grill, resulting in a stream of heated air. The heating element within a traditional heating enabled fan restricts its physical dimensions by requiring its incorporation within the path of the air stream produced by the fan in such a way that will not obstruct the air flow. Furthermore, the constant forcing of the air through the heating element may subject it to such foreign matter as dust particles, grease and insects, causing it to degrade and eventually malfunction.

U.S. Pat. No. 6,393,211 discloses a fan-less reflector heating device, another U.S. Pat. No. 5,636,318 teaches a direct heater comprising heating means and fan. The former suffers from poor dispersion of the heated air, the latter subjects the heating means to environmental degradation.

SUMMARY OF THE INVENTION

It would thus be desirable to achieve a device that ventilates the air and efficiently indirectly heats an air stream, without subjecting the heating element to the adverse effects of the air stream contents.

Therefore, in accordance with a preferred embodiment of the present invention, there is provided a parabolic reflection heating enabled ventilation fan, constructed of a parabolic reflector dish reflecting the heat from a heating element into an air stream produced by a ventilation fan.

The device of the present invention has many technological advantages, among them:

The avoidance of the adverse effects of direct contact between the air steam and the heating element.

The simple integration of the heating element into the axle construction of a conventional fan.

The simplicity of construction.

The simplicity of access to the fan blade structure for the purpose of cleaning and maintenance.

The straightforward application to both standing and ceiling fans.

Additional features and advantages of the invention will become apparent from the following drawings and description.

The parabolic reflective heater is also activated by human voice or mechanical voice, or synthetic voice, or music, and preferably comprising a remote control.

BRIEF DESCRIPTION OF THE DRAWINGS

For a better understanding of the invention with regard to the embodiments thereof, reference is made to the accompanying drawings (not to scale), in which like numerals designate corresponding sections or elements throughout, and in which.

DETAILED DESCRIPTION OF THE PREFERRED EMBODIMENTS

The present invention to be utilized in home appliances as well as agricultural and industrial environments relates to a heat reflection ventilation fan or blower, wherein a parabolic dish reflects heat generated by a heating element, which is fitted onto the conventional rotation axle that transfers power from the electrical motor to the fan blades, into the path of the air stream produced by the attached conventional ventilation apparatus.

A ventilation fan is a device for creating a current of air or a breeze, especially a machine using an electric motor to rotate thin, rigid blades in order to move air. Similarly a blower fan utilizes an electric motor to rotate a ring, fitted horizontally, with rigid blades within a snail shaped volume with a circular air intake in parallel with the direction of the ring blades and matching the ring size, and an exhaust in perpendicular to the direction of the ring blades.

Heat reflective surfaces are defined by a suitable metallic layer or coating or by a lamination of metallic film. They may be flat or parabolic, single focal or multi focal, continuous or non-continuous.

Heating elements are varied and include a multitude of heat emitting bulbs and wires.

The heated air blown from the fan flows indirectly to the air stream. Unlike commonly used heating fans, the air stream is reflected by the fan to a reflecting element. Said reflection scatters the air in a unitary manner, compared with commonly used fans. The indirect path of said air stream is performed by wither vertical or horizontal reflection.

Figure 1:
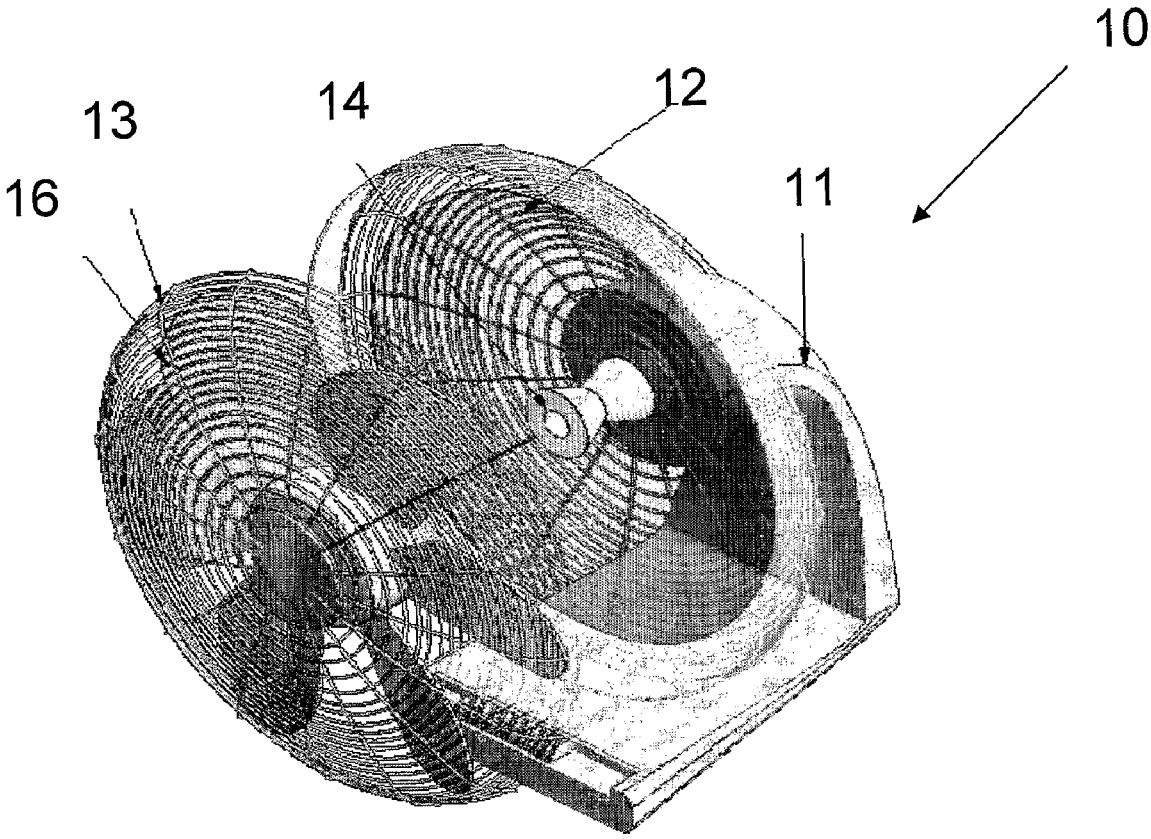
FIG. 1 is a general, blow-up view of a table top parabolic heat reflection fan constructed in accordance with the principles of the present invention in a preferred embodiment thereof.

FIG. 1 is a general blow-up view of table top parabolic heat reflection fan device 10, composed of conventional housed motor unit 11, attached to the non reflective insulated side of parabolic dish 12, with its circulation axle protruding through the center of dish 12 incased within heating element 14, and connected to blade fan structure 16, which is covered by finger protection grill 13. The heat produced by heat element 14 is reflected by the inner reflective side of dish 12, into the air stream generated by the power of motor unit 11 and transferred to blade structure 16.

Figure 2:
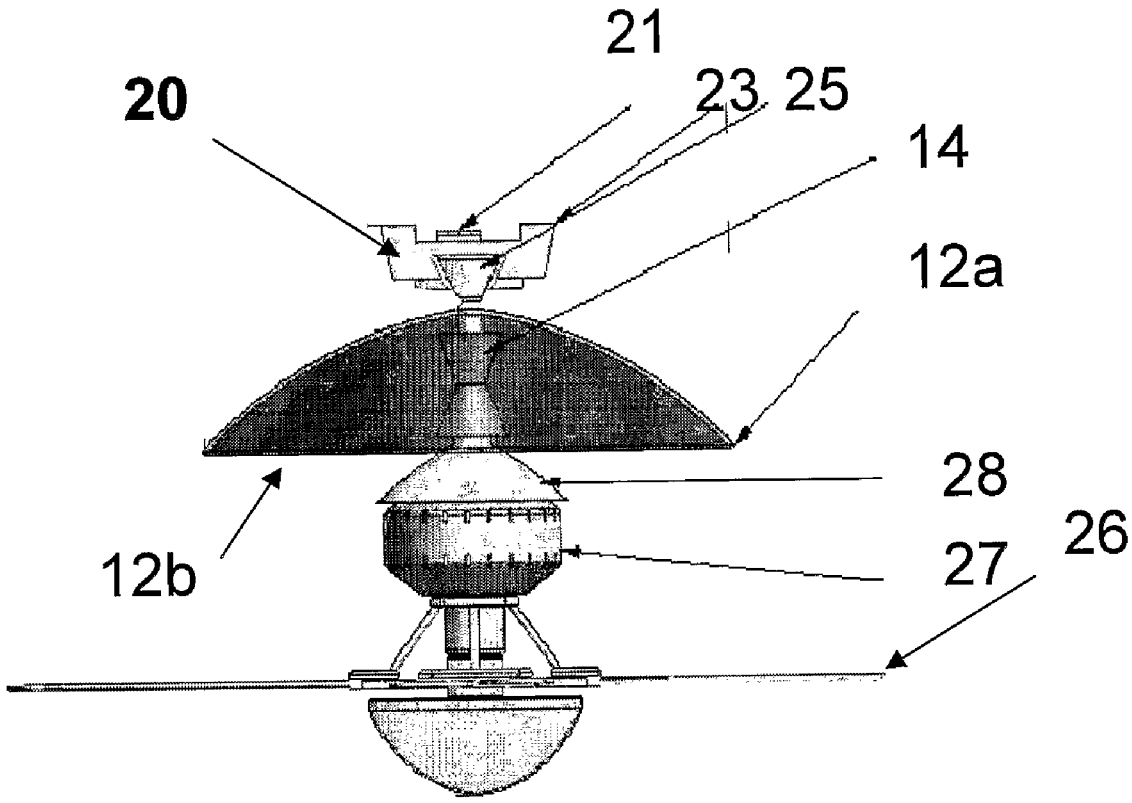
FIG. 2 is a general, cross-section view of the fan heater technology described herein adapted so to be ceiling attachable.

FIG. 2 is a general, cross-section view of a ceiling attachable embodiment of FIG. 1, wherein hanger bracket 23 is attachable to the ceiling and incases electrical junction box 21 that connects the electrical mains to heating element 14 and conventional ceiling fan 26 and lamp 27. The outer non reflective insulated side 12*a* of parabolic dish 12 is attached to bracket 23 with ceiling rod 25 protruding through the center of dish 12. The protruding part of ceiling rod 25 is engulfed by heating element 14, with the inner reflective side 12*b* of parabolic dish 12 reflecting the heat from said element. Ceiling rod 25 further extends through heat protecting cover 28 to connect to the motor of conventional ceiling fan 26, which rotates the fan blades by means of the axle created by ceiling rod 25.

The invention claimed is:

1. A heating fan, comprising a motor unit, attached to a non reflective insulated side of a parabolic dish, a motor unit circulation axle or rod (MUCAR) protruding through a center of said dish, said MUCAR encased within at least one heating element, said MUCAR further extending through heat protecting cover and further connecting to a blade fan structure, such that heating produced by said heating element is reflected by the inner reflective side of said dish into the air stream generated by said motor unit and transferred to the current of air created by said fan, such that said blade structure is located in front of said heating element and said parabolic dish such that air flow created by said blade structure is directed to said reflector through a proximity of said heating element.

2. The heating fan of claim 1, further comprising at least one container of fragrant volatiles being interconnected to at least one dispenser emitting said fragrant volatile continuously or discreetly.

3. The heating fan of claim 1, wherein the reflective element is non-parabolically shaped.

4. The heating fan of claim 1, wherein the heating element is a heat emitting bulb.

5. The heating fan of claim 1, wherein the heating element is a heat emitting wire.

6. The heating fan of claim 1, incorporated in a free standing embodiment.

7. The heating fan of claim 1, incorporated in a ceiling attachable embodiment.

8. The heating fan of claim 1, activated by human voice or mechanical voice, or synthetic voice, or music.

9. The heating fan of claim 1, further comprising a remote control.

* * * * *